US007044512B1

(12) United States Patent
Moreno

(10) Patent No.: US 7,044,512 B1
(45) Date of Patent: May 16, 2006

(54) BAR SEAL FOR SHIPPING CONTAINER

(76) Inventor: Jose M. Moreno, 2270 NW. 87 Terr., Pembroke Pines, FL (US) 33024

( * ) Notice: Subject to any disclaimer, the term of this patent is extended or adjusted under 35 U.S.C. 154(b) by 164 days.

(21) Appl. No.: 10/887,691

(22) Filed: Jul. 12, 2004

(51) Int. Cl.
*E05C 19/00* (2006.01)
*E05C 19/18* (2006.01)
*E05C 21/02* (2006.01)

(52) U.S. Cl. ..... 292/259 R; 340/572.9; 70/14; 292/282

(58) Field of Classification Search ..... 292/259 R, 292/282; 70/14; 340/572.9
See application file for complete search history.

(56) References Cited

U.S. PATENT DOCUMENTS 4,812,823 A * 3/1989 Dickerson ..... 340/573.4
5,120,097 A * 6/1992 Fattori et al. ..... 292/318
5,284,036 A * 2/1994 Rosenbaum ..... 70/14
6,265,973 B1 * 7/2001 Brammall et al. ..... 340/568.1

* cited by examiner

*Primary Examiner*—Gary Estremsky
(74) *Attorney, Agent, or Firm*—Albert Bordas

(57) ABSTRACT

A single-use security bar seal assembly for shipping containers, comprising an elongated bar member having first and second ends, a support assembly, and a receiving bracket. The single-use security bar seal assembly has matching identification codes on all individual parts and electrical means for determining severance of the elongated bar member.

10 Claims, 11 Drawing Sheets

FIG. 3a
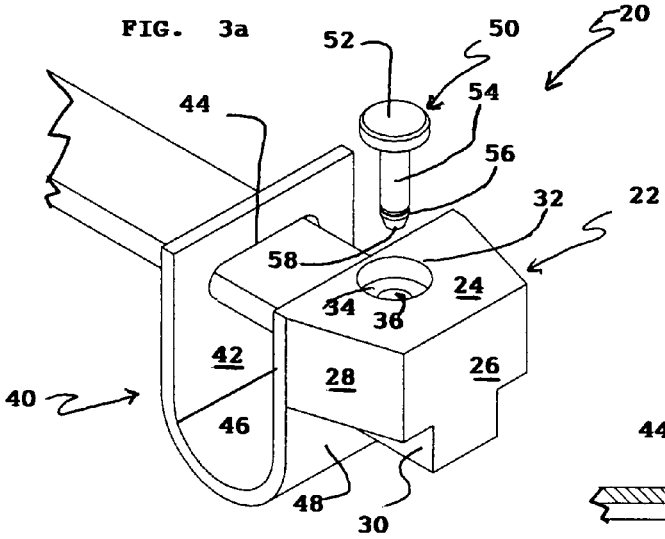
FIG. 3c
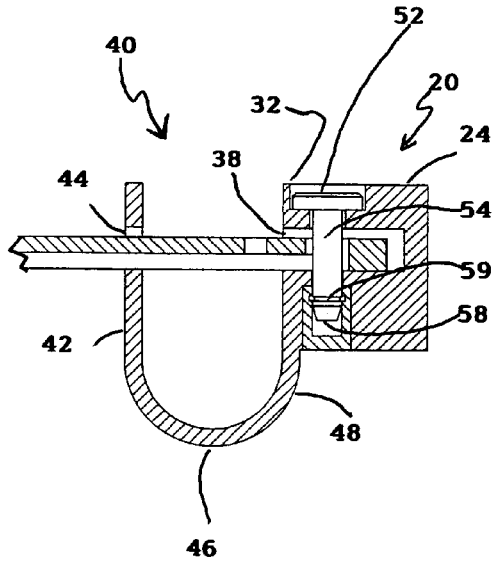
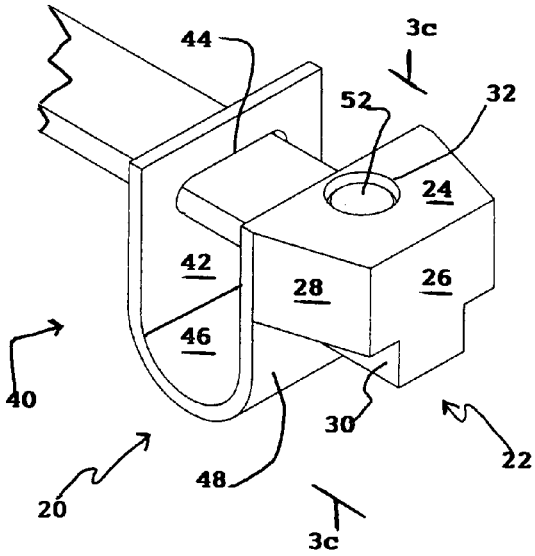
FIG. 3b

BAR SEAL FOR SHIPPING CONTAINER

BACKGROUND OF THE INVENTION

1. Field of the Invention

The present invention relates to security systems and more particularly, to security bar seals for shipping containers.

2. Description of the Related Art

Millions of shipping containers flow through ports all over the world on a daily basis. It is imperative to keep the contents of those shipping containers secure and not have them compromised. In addition to theft of contents, there is a need to ensure that shipping containers are not used as vehicles to transport illegal narcotics, illegal weapons, and otherwise unauthorized matter.

Several designs for bar seals have been designed in the past. Applicant, however, is not aware of any bar seal that includes a single-use security bar seal system comprising identification matching codes on all individual parts and electrical means for determining severance of the bar assembly.

SUMMARY OF THE INVENTION

A single-use security bar seal assembly for shipping containers, comprising an elongated bar member having first and second ends, wherein the first end has a protrusion. The elongated bar member has a first aperture of a predetermined depth between the first and second ends and a second aperture of the predetermined depth between the first aperture and the second end. The elongated bar member further has at least one through hole in between the second aperture and the second end and electrical means for detecting severance of the elongated bar member.

A support assembly has a first U-shaped member that has first and second slots to receive the second end therethrough. A receiving bracket has a second U-shaped member connected to a housing. The second U-shaped member has third and fourth slots to receive the second end. The housing comprises locking means to lock the elongated bar member to the support assembly and the receiving bracket.

The locking means comprises the receiving bracket having a third aperture with a snap ring to receive a locking pin. The locking pin has at least one groove to receive the snap ring when the locking pin is aligned with the at least one through hole and presented into the third aperture with sufficient force to overcome the snap ring.

The electrical means comprises the first and second apertures connected to each other by an element capable of an uninterrupted succession or flow of electrical current. The first and second apertures may be tested with a continuity testing assembly to detect if the elongated bar member has been severed. The element is a metallic strip embedded within the elongated bar member between the first and second apertures.

The elongated bar member, the support assembly, and the receiving bracket have matching identification codes and secret codes.

The continuity testing assembly comprises a wand and an insert connected to one another by a wire. The continuity testing assembly is used to detect if the metallic strip has been severed.

The continuity testing assembly comprises a light emitting or sound producing alarm for negative electrical continuity and/or light emitting or sound producing alarm for positive electrical continuity.

The first and second U-shaped members snugly fit around door bars of a container and in the preferred embodiment the container is a shipping container.

It is one of the main objects of the present invention to provide a bar seal for shipping containers that is effective against tampering.

It is another object of this invention to provide a bar seal for shipping containers that is durable.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3*a* shows the first perspective view of the receiving bracket with the bar member in position to be locked with the pin.

FIG. 3*b* shows the first perspective view of the receiving bracket locking the bar member with the pin.

FIG. 3*c* is a cut view of the receiving bracket locking the bar member with the pin taken along the lines 3*c*—3*c*, as seen in FIG. 3*b*.

DETAILED DESCRIPTION OF THE PREFERRED EMBODIMENT

Figure 1:
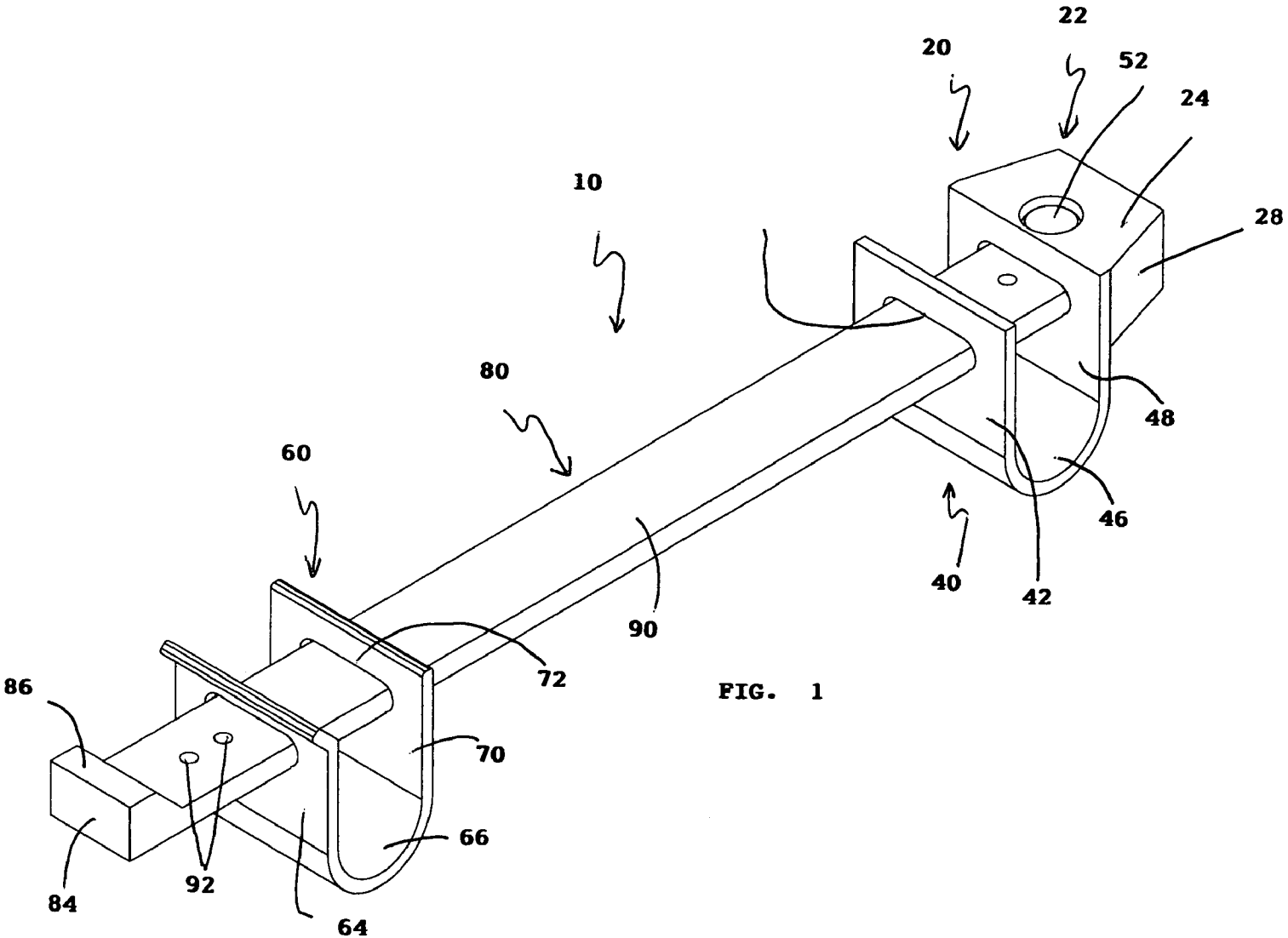
FIG. 1 represents a perspective view of the instant invention.

Referring now to the drawings, where the present invention is generally referred to with numeral 10, it can be observed that it basically includes receiving bracket 20, support assembly 60, and bar member 80.

As seen in FIG. 1, the instant invention comprises receiving bracket 20 and support assembly 60 locking bar member 80, whereby receiving bracket 20 and support assembly 60 have slots of cooperative characteristics to receive bar member 80 therethrough.

Figure 2:
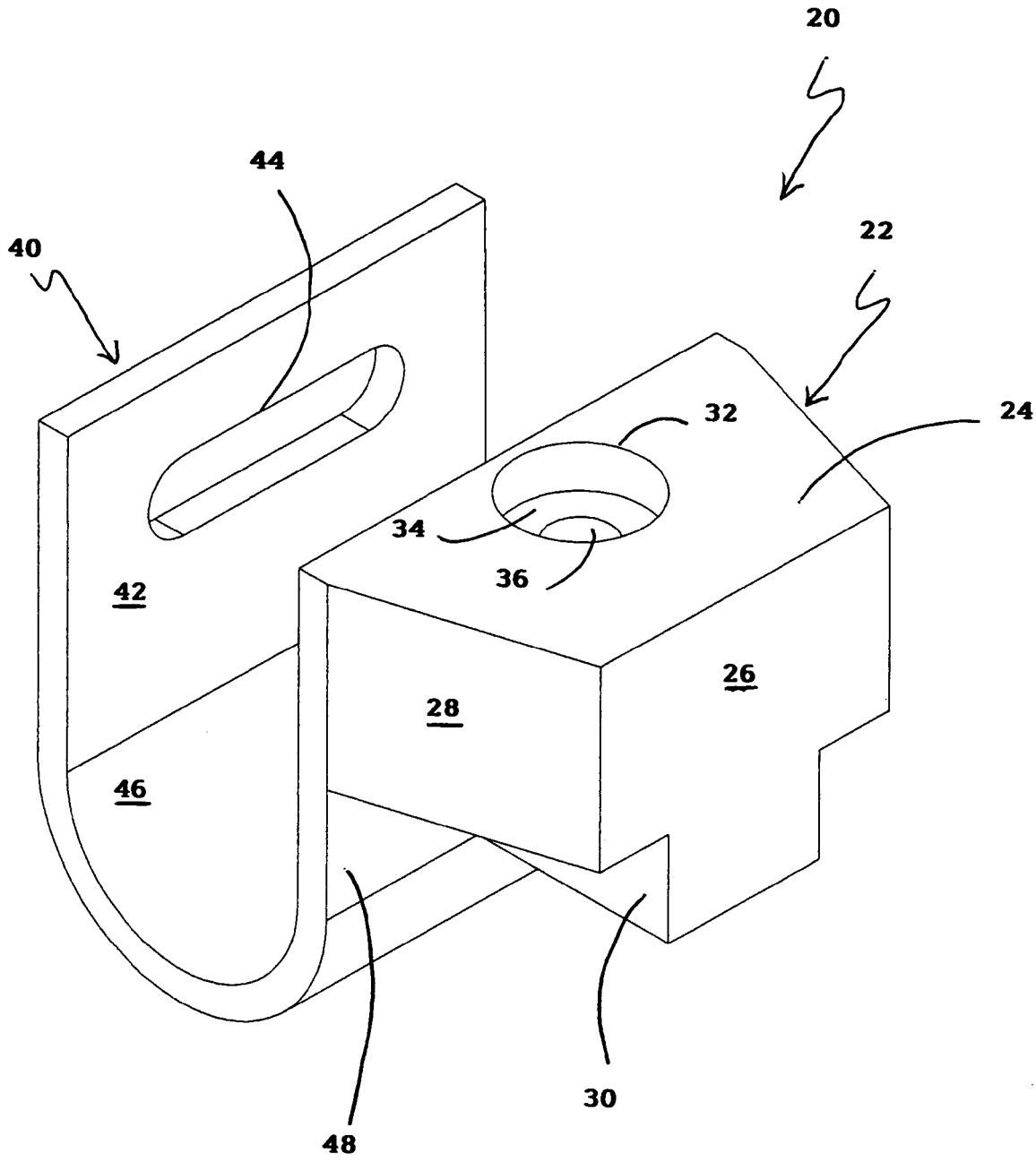
FIG. 2 shows a first perspective view of the receiving bracket.
Figure 3:
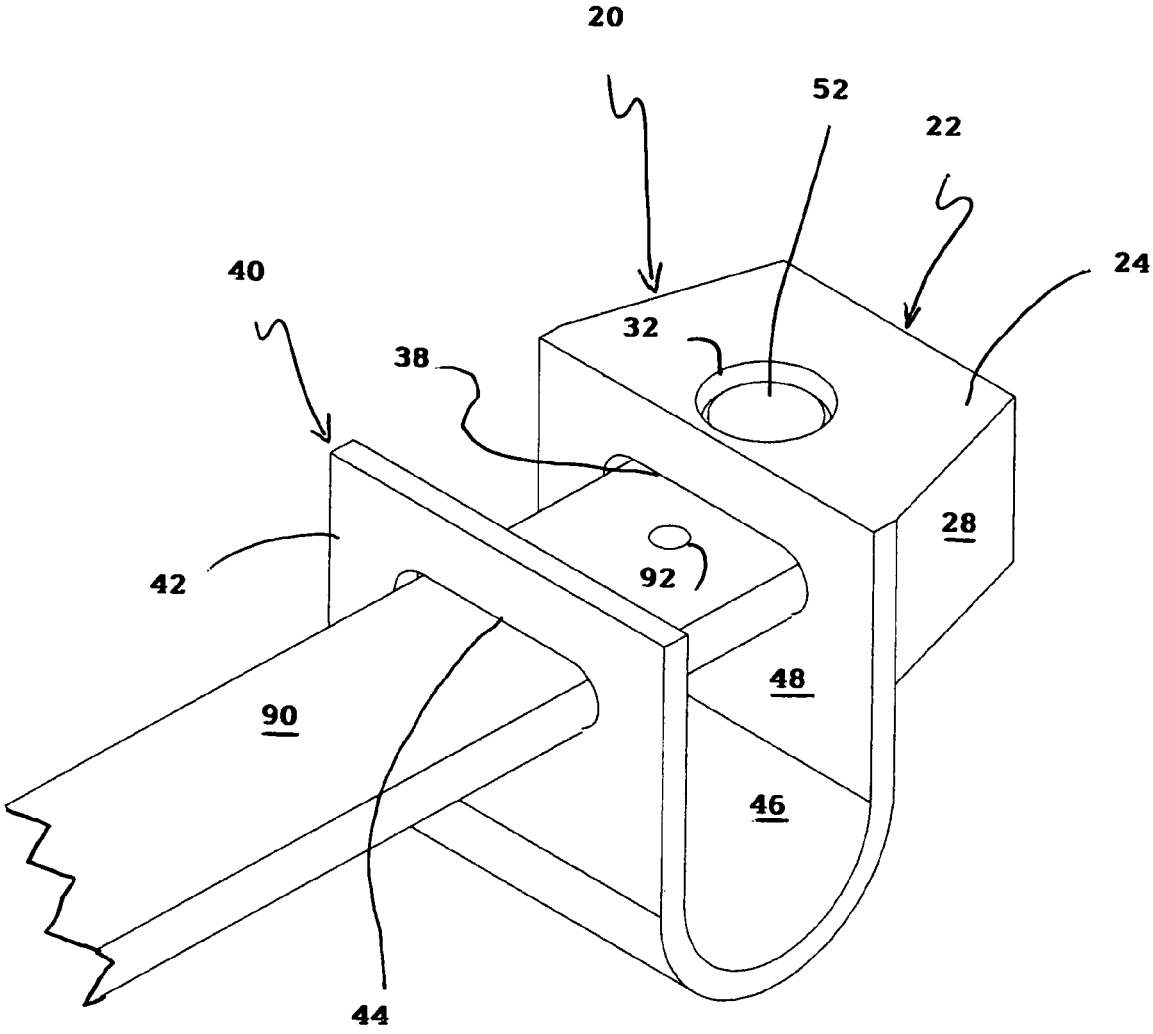
FIG. 3 shows a second perspective view of the receiving bracket locking the bar member with a pin.

As best seen in FIGS. 2 and 3, receiving bracket 20 comprises receiving assembly 22 and support 40. Receiving assembly 22 comprises wall 24 having aperture 32 to receive pin 50. Within aperture 32 is face 34, and aperture 36 of a smaller diameter than aperture 32 to receive shank 54, seen in FIG. 3*a*. Perpendicularly from face 24 are walls 26, 28, and 30, which form receiving assembly 22. It is noted that the walls opposite from walls 28 and 30, not seen, are a mirror image of walls 28 and 30.

Support 40 is connected to receiving assembly 22. Support 40 comprises walls 42 and 48 parallel and equally spaced apart from each other by curved wall 46. Wall 42 has slot 44 of cooperative characteristics to receive bar member 80 therethrough.

FIG. 3 shows elongated member 90 secured through slots 44 and 38, and locked by pin 50 having head 52.

As seen in FIG. 3*a*, elongated member 90 has been secured through slots 44 and 38. Pin 50 comprises head 52. Extending from head 52 is shank 54 having groove 56 and terminating at end 58.

As seen in FIGS. 3*b* and 3*c*, pin 50 has been snapped into position within aperture 32, thus locking bar member 80. As best seen in FIG. 3*c*, ring 59, within aperture 36, snaps and locks around groove 56 of shank 54.

Figure 4:
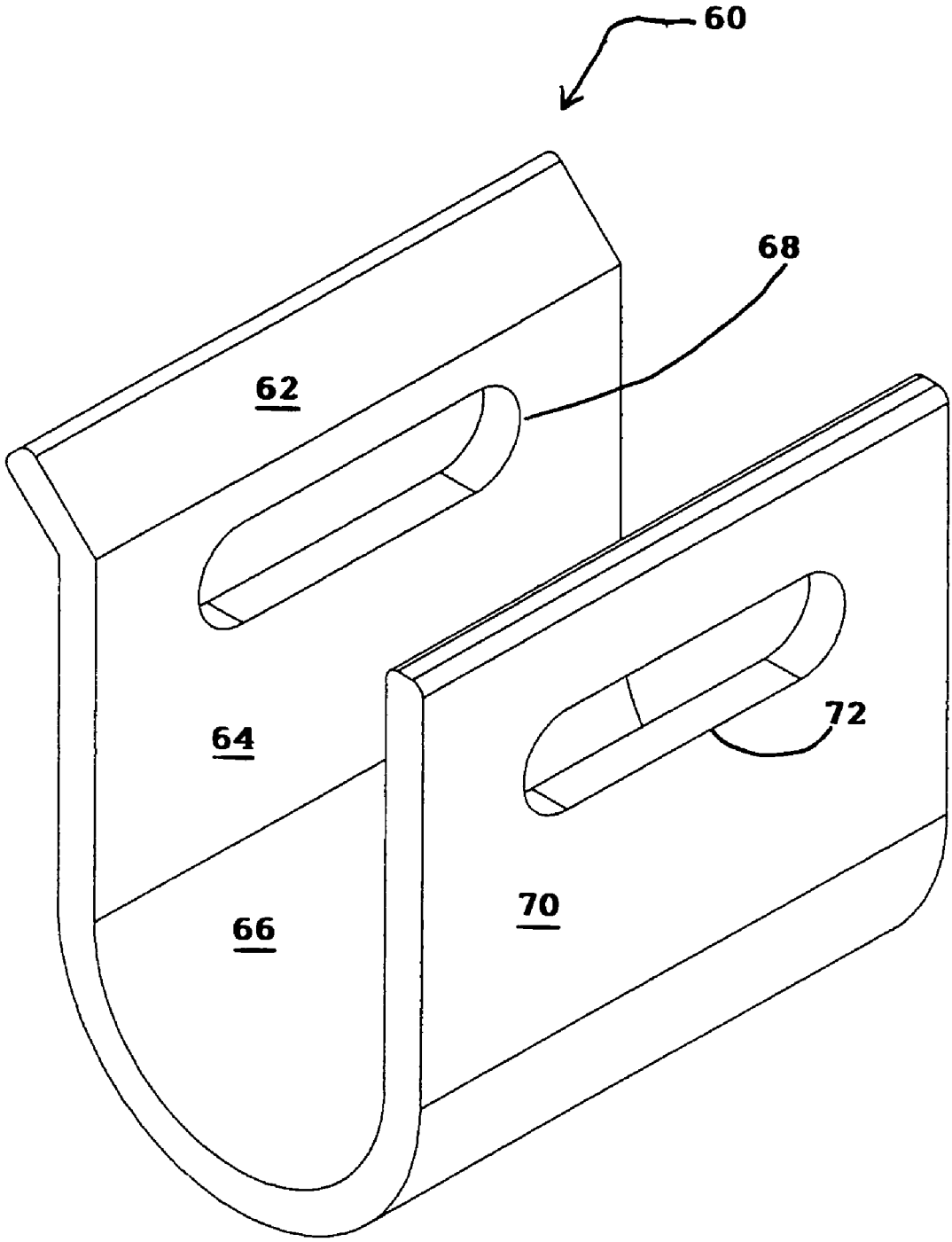
FIG. 4 shows a perspective view of the support assembly.

As seen in FIG. 4, support assembly 60 comprises walls 64 and 70 parallel and equally spaced apart from each other by curved wall 66. Walls 64 and 70 have slots 68 and 72 respectively of cooperative characteristics to receive bar member 80 therethrough. Extending at a predetermined angle from wall 64 is lip 62.

Figure 5:
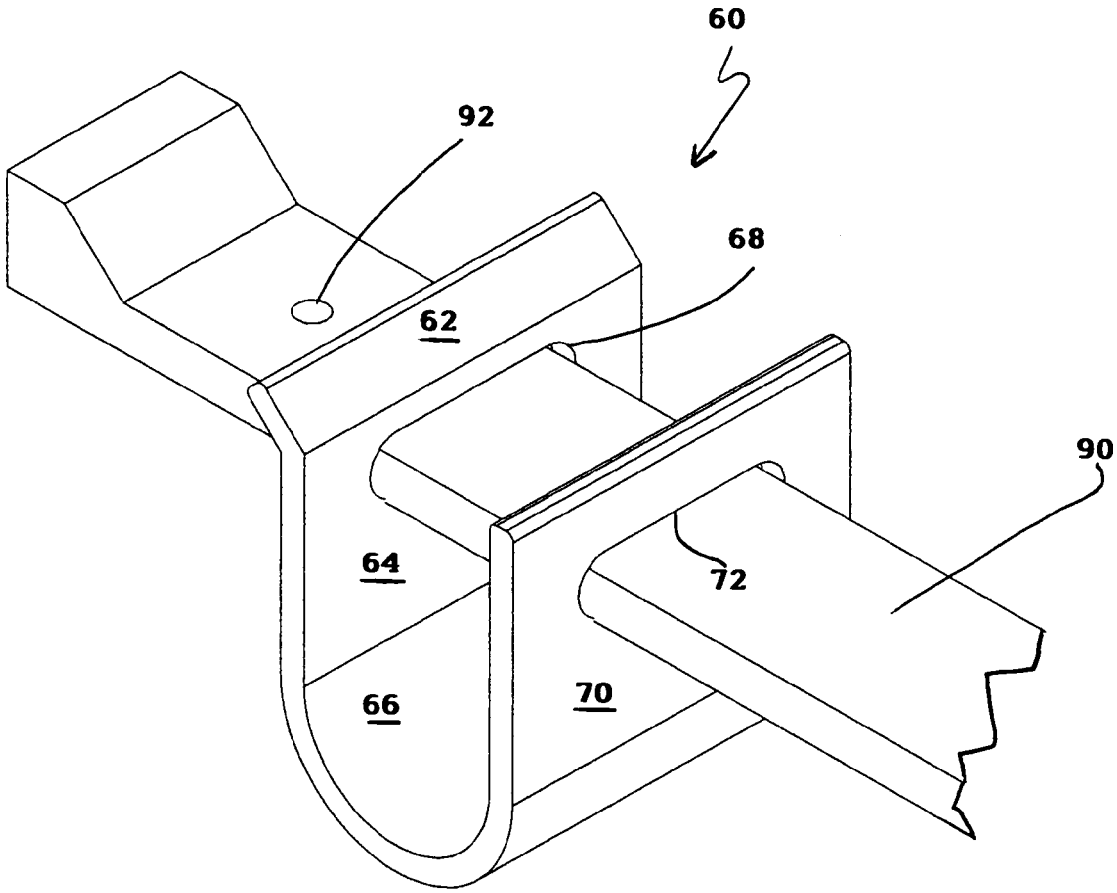
FIG. 5 shows a perspective view of the support assembly supporting the bar member.

As seen in FIG. 5, slots 68 and 72 have received bar member 80 for support.

Figure 6:
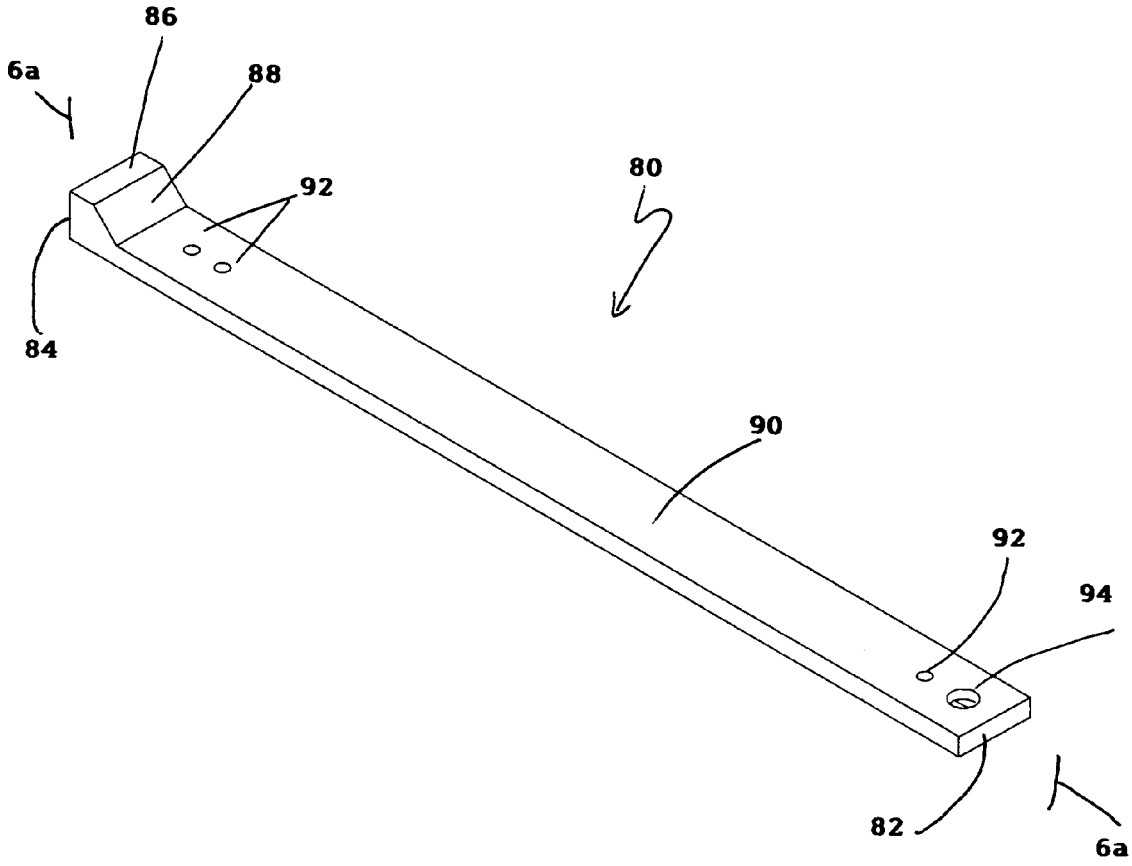
FIG. 6 illustrates a perspective view of the bar member.
Figure 6A:
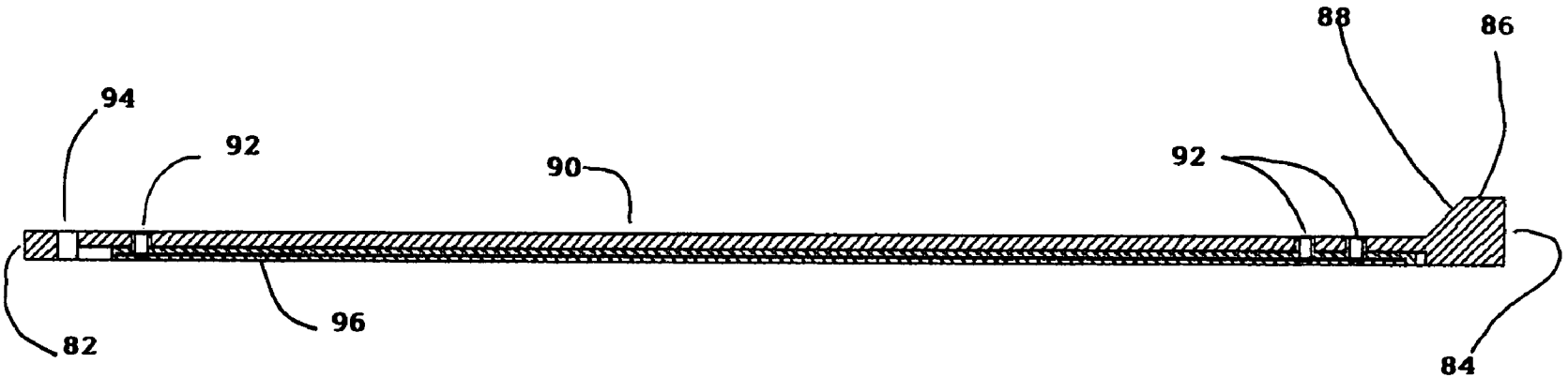
FIG. 6*a* is a cut view of the bar member taken along the line 6*a*—6*a*, as seen in FIG. 6.

As seen in FIG. 6, bar member 80 comprises elongated member 90 having ends 82 and 84. Extending from end 84 is wall 86 of a predetermined length. Extending at a predetermined angle from wall 86 is wall 88. It is noted that walls 86 and 88 are shaped to lock end 84 with support assembly 60. Elongated member 90 comprises contact points 92 and aperture 94.

As best seen in FIG. 6, bar member 80 has metallic strip 96 extending to each of contact points 92. In the preferred embodiment, bar member 80 has at least two contact points 92 positioned near ends 82 and 84. Electrical means, seen in FIG. 7*b*, are used with contact points 92 for determining severance of the bar member 80. More specifically, electrical continuity testing may be conducted to ensure metallic strip 96 has not been severed.

Figure 7:
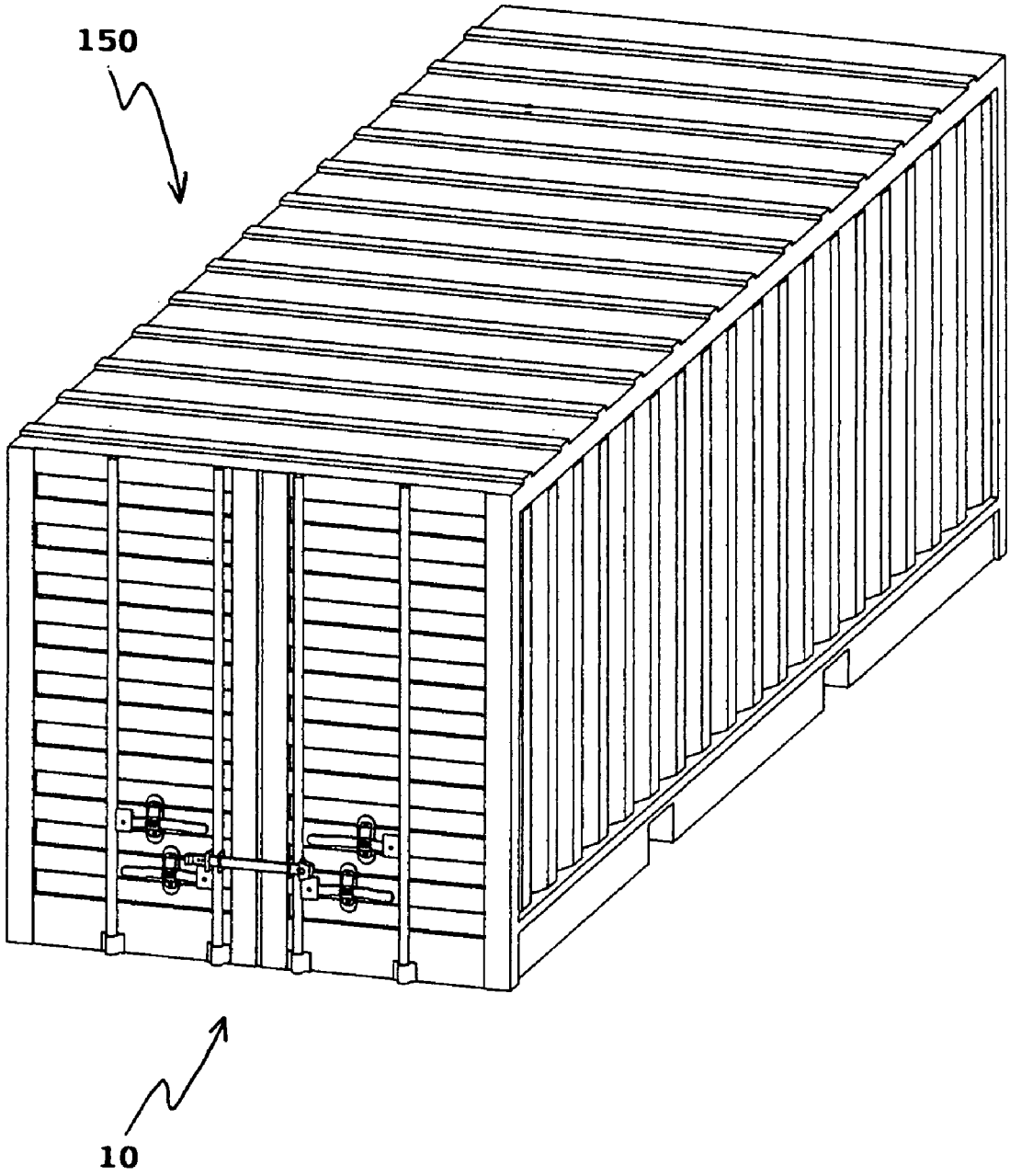
FIG. 7 represents a perspective view of the instant invention mounted onto a shipping container.
Figure 7A:
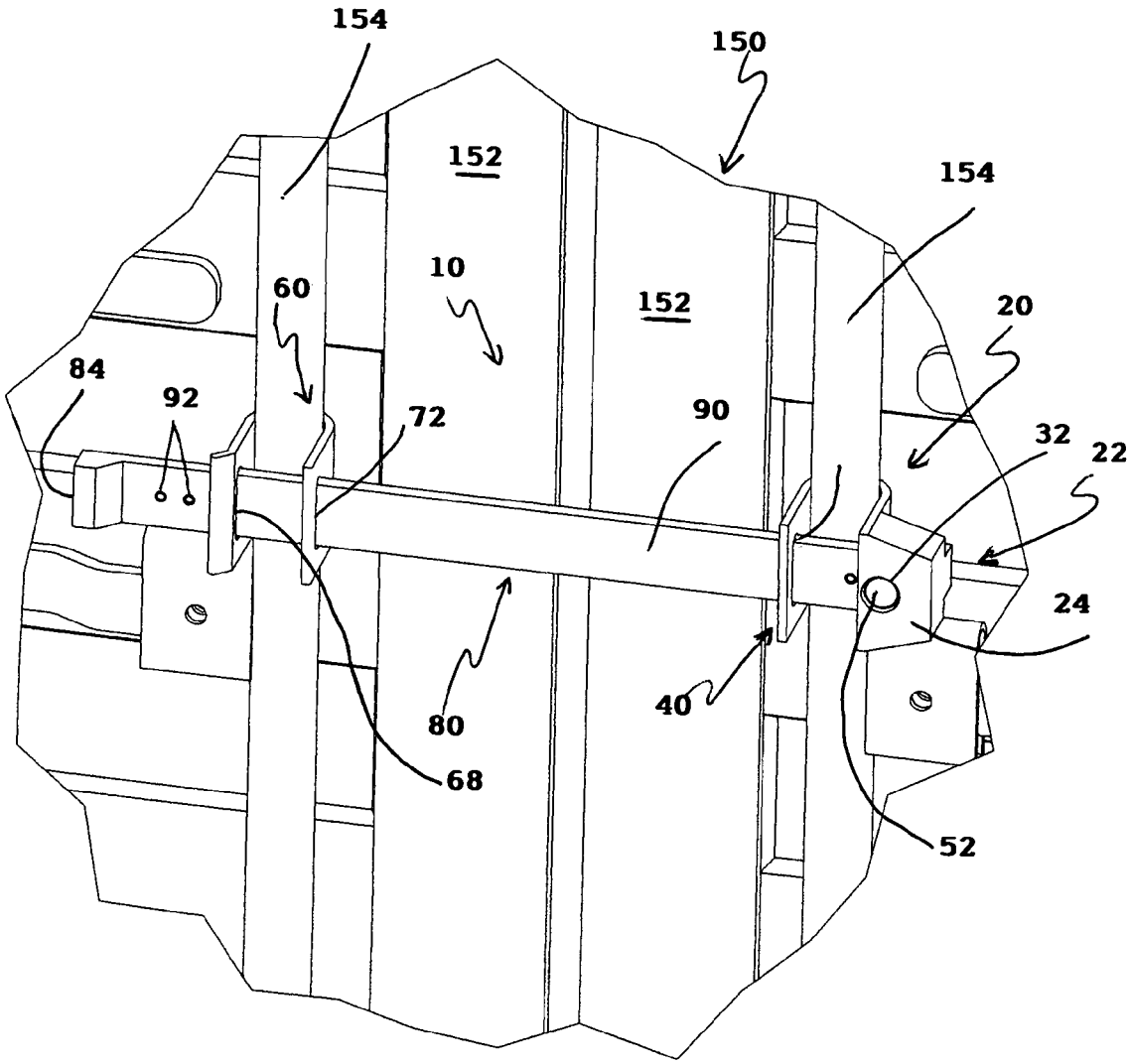
FIG. 7*a* represents a close-up perspective view of the instant invention mounted onto the shipping container bars.
Figure 7B:
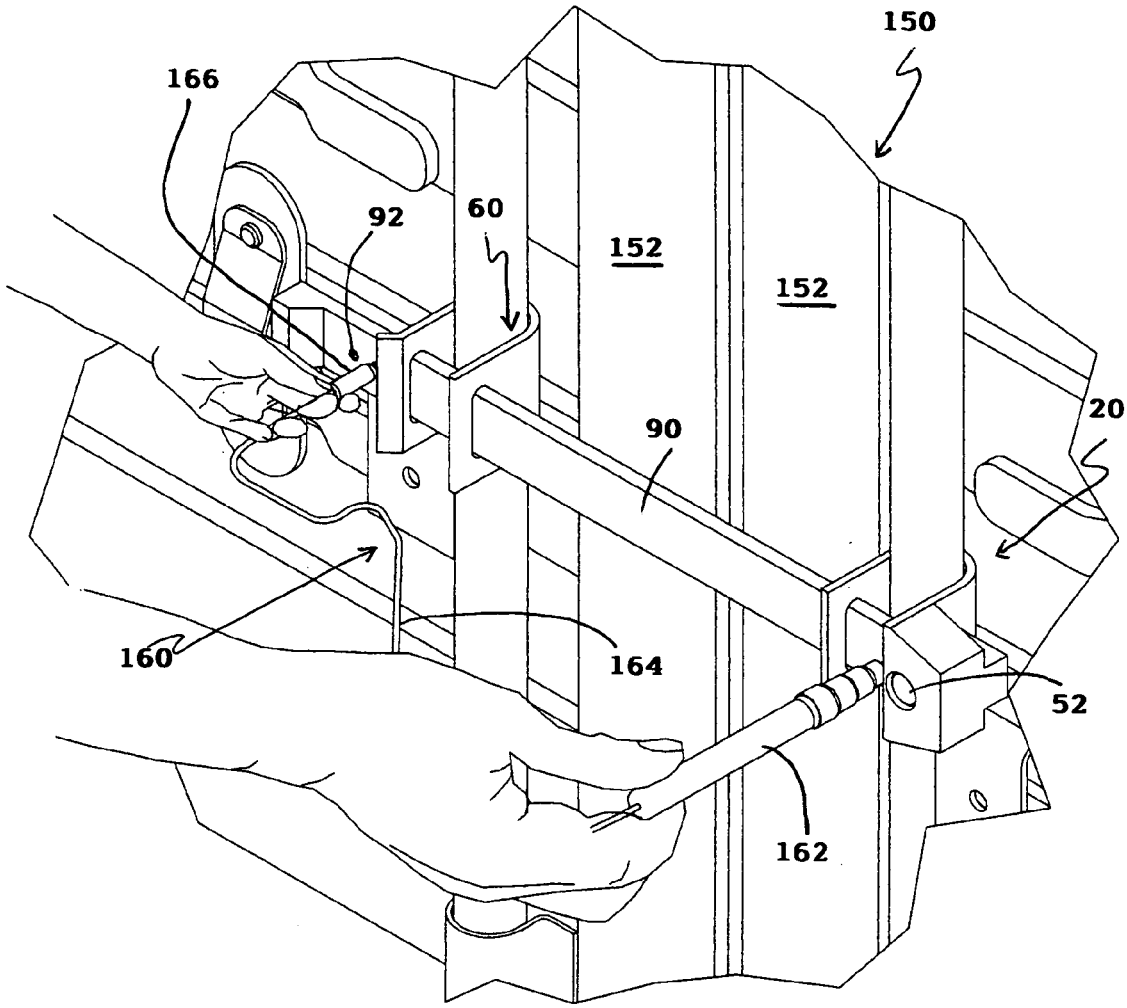
FIG. 7*b* represents a perspective view of the instant invention mounted on a shipping container bars and being tested for severance of the bar member.

As seen in FIGS. 7 and 7*a*, instant invention 10 may be mounted upon a standard shipping container 150 having doors 152 with bars 154. As seen in the present illustration, curved walls 46 and 66 of receiving bracket 20 and support assembly 60 respectively, snugly fit around bars 154. Other embodiments of the present invention may include curved walls 46 and 66 of different sizes to accommodate various bar 154 circumferences of doors 152.

As seen in FIG. 7*b*, continuity testing assembly 160 comprises wand 162 and insert 166 connected to one another by wire 164. With continuity testing assembly 160, a person may determine if bar member 80 has been severed. More specifically, electrical continuity testing is performed by inserting insert 166 into a contact point 92 while inserting the tip of wand 162 into another contact point 92 to detect if metallic strip 96 has been severed. Continuity testing assembly 160 may include a light emitting or sound producing alarm for negative electrical continuity and/or light emitting or sound producing alarm for positive electrical continuity.

It is noted that the receiving bracket 20, support assembly 60, and bar member 80 have matching identification codes, wherein each of the components have matching codes. The receiver may inspect each of receiving bracket 20, support assembly 60, and bar member 80 to ensure that they do in fact have matching codes. In the event the receiver determines that the matching identification codes do not match, the receiver is on notice that the contents of the shipping container 150 may have been disturbed or otherwise tampered with.

Furthermore, in addition to the matching identification codes, instant invention 10 may comprise random secret codes made up of number(s), word(s), and/or any symbol that may be stamped on receiving bracket 20, support assembly 60, and bar member 80. The secret codes are stamped on any of receiving bracket 20, support assembly 60, and bar member 80 and are known only by the sender and receiver in the preferred embodiment. Before severing bar member 80 to open the shipping container 150, the receiver, knowing the secret codes, can determine if any of receiving bracket 20, support assembly 60, and/or bar member 80 were replaced after being sent by the sender. In the event the receiver determines that the secret codes do not match those originating from the sender, the receiver is on notice that the contents of the shipping container 150 may have been disturbed or otherwise tampered with.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A single-use security bar seal assembly for shipping containers, comprising:

A) an elongated bar member having first and second ends, the first end having a protrusion, the elongated bar member has a first aperture of a predetermined depth between the first and second ends and a second aperture of the predetermined depth between the first aperture and the second end, the elongated bar member further having at least one through hole in between the second aperture and the second end and electrical means for detecting severance of the elongated bar member;

B) a support assembly having a first U-shaped member, the first U-shaped member having first and second slots to receive the second end therethrough; and C) a receiving bracket having a second U-shaped member connected to a housing, the second U-shaped member having third and fourth slots to receive the second end, the housing comprising locking means to lock the elongated bar member to the support assembly and the receiving bracket.

2. The single-use security bar seal assembly for shipping containers set forth in claim 1, further characterized in that the locking means comprises the receiving bracket having a third aperture with a snap ring to receive a locking pin, the locking pin having at least one groove to receive the snap ring when the locking pin is aligned with the at least one through hole and presented into the third aperture with sufficient force to overcome the snap ring.

3. The single-use security bar seal assembly for shipping containers set forth in claim 2, further characterized in that the electrical means comprises the first and second apertures connected to each other by an element capable of an uninterrupted succession or flow of electrical current, the first and second apertures tested with a continuity testing assembly to detect if the elongated bar member has been severed.

4. The single-use security bar seal assembly for shipping containers set forth in claim 3, further characterized in that the element is a metallic strip embedded within the elongated bar member between the first and second apertures.

5. The single-use security bar seal assembly for shipping containers set forth in claim 4, further characterized in that the elongated bar member, the support assembly, and the receiving bracket have matching identification codes.

6. The single-use security bar seal assembly for shipping containers set forth in claim 5, further characterized in that the continuity testing assembly comprises a wand and an insert connected to one another by a wire, the continuity testing assembly used to detect if the metallic strip has been severed.

7. The single-use security bar seal assembly for shipping containers set forth in claim 6, further characterized in that the continuity testing assembly comprises a light emitting or sound producing alarm for negative electrical continuity and/or light emitting or sound producing alarm for positive electrical continuity.

8. The single-use security bar seal assembly for shipping containers set forth in claim 7, further characterized in that the a first and second U-shaped members snugly fit around door bars of a container.

9. The single-use security bar seal assembly for shipping containers set forth in claim 8, further characterized in that the container is a shipping container.

10. The single-use security bar seal assembly for shipping containers set forth in claim 9, further characterized in that the elongated bar member, the support assembly, and the receiving bracket have secret codes.

* * * * *